US008627608B2

(12) United States Patent
Van Stokkum

(10) Patent No.: US 8,627,608 B2
(45) Date of Patent: Jan. 14, 2014

(54) DEMOUNTABLE SEATING AND METHOD FOR ERECTING A DEMOUNTABLE SEATING

(75) Inventor: Carolus Adrianus Josephus Van Stokkum, Elshout (NL)

(73) Assignee: Van Stokkum Holding Vlijmen B.V. (NL)

( * ) Notice: Subject to any disclaimer, the term of this patent is extended or adjusted under 35 U.S.C. 154(b) by 0 days.

(21) Appl. No.: 13/373,891

(22) Filed: Dec. 5, 2011

(65) Prior Publication Data

US 2012/0102845 A1 May 3, 2012

Related U.S. Application Data

(63) Continuation of application No. 12/086,209, filed as application No. PCT/NL2006/000631 on Dec. 11, 2006, now abandoned.

(30) Foreign Application Priority Data

Dec. 9, 2005 (NL) ..... 1030641
Mar. 9, 2006 (EP) ..... 06075560

(51) Int. Cl.
*E04H 3/12* (2006.01)

(52) U.S. Cl.
USPC ..... 52/6

(58) Field of Classification Search
USPC ..... 52/6, 8, 9, 10, 182, 188, 646
See application file for complete search history.

(56) References Cited

U.S. PATENT DOCUMENTS

| | | | | |
|---|---|---|---|---|
| 2,060,436 | A | 11/1936 | Wetzel | |
| 2,180,986 | A | 11/1939 | Lambert | |
| 2,297,101 | A | 9/1942 | Greenwell et al. | |
| 2,736,613 | A | 2/1956 | Jagiel | |
| 4,195,451 | A | 4/1980 | Jarvis | |
| 5,050,353 | A * | 9/1991 | Rogers et al. | 52/8 |
| 5,572,847 | A | 11/1996 | Elmore et al. | |
| 5,787,656 | A | 8/1998 | D'Antonio | |
| 6,484,450 | B1 | 11/2002 | Suprina et al. | |
| 6,598,351 | B2 | 7/2003 | Hallberg | |

FOREIGN PATENT DOCUMENTS

| | | | |
|---|---|---|---|
| DE | 2001244 | A1 | 7/1971 |
| FR | 2754005 | A1 | 4/1998 |
| GB | 2394481 | A | 4/2004 |
| JP | 03293447 | A | 12/1991 |
| JP | 09096009 | A | 4/1997 |

* cited by examiner

*Primary Examiner* — Christine T Cajilig
(74) *Attorney, Agent, or Firm* — Banner & Witcoff, Ltd.

(57) ABSTRACT

Removable stand and method for constructing a removable stand. The method comprises constructing a support structure of posts and trusses that are positionable between the posts, and positioning a floor element on the support structure. Herein the floor element comprises a plurality of floor levels positioned behind each other and positioned at a distance in height and/or is the floor element, before it is positioned on the support structure, provided with at least one seat and/or bench and/or is floor element provided with connection means for connecting at least one seat and/or bench thereto.

53 Claims, 13 Drawing Sheets

DEMOUNTABLE SEATING AND METHOD FOR ERECTING A DEMOUNTABLE SEATING

CROSS-REFERENCE TO RELATED APPLICATIONS

Figure 1:
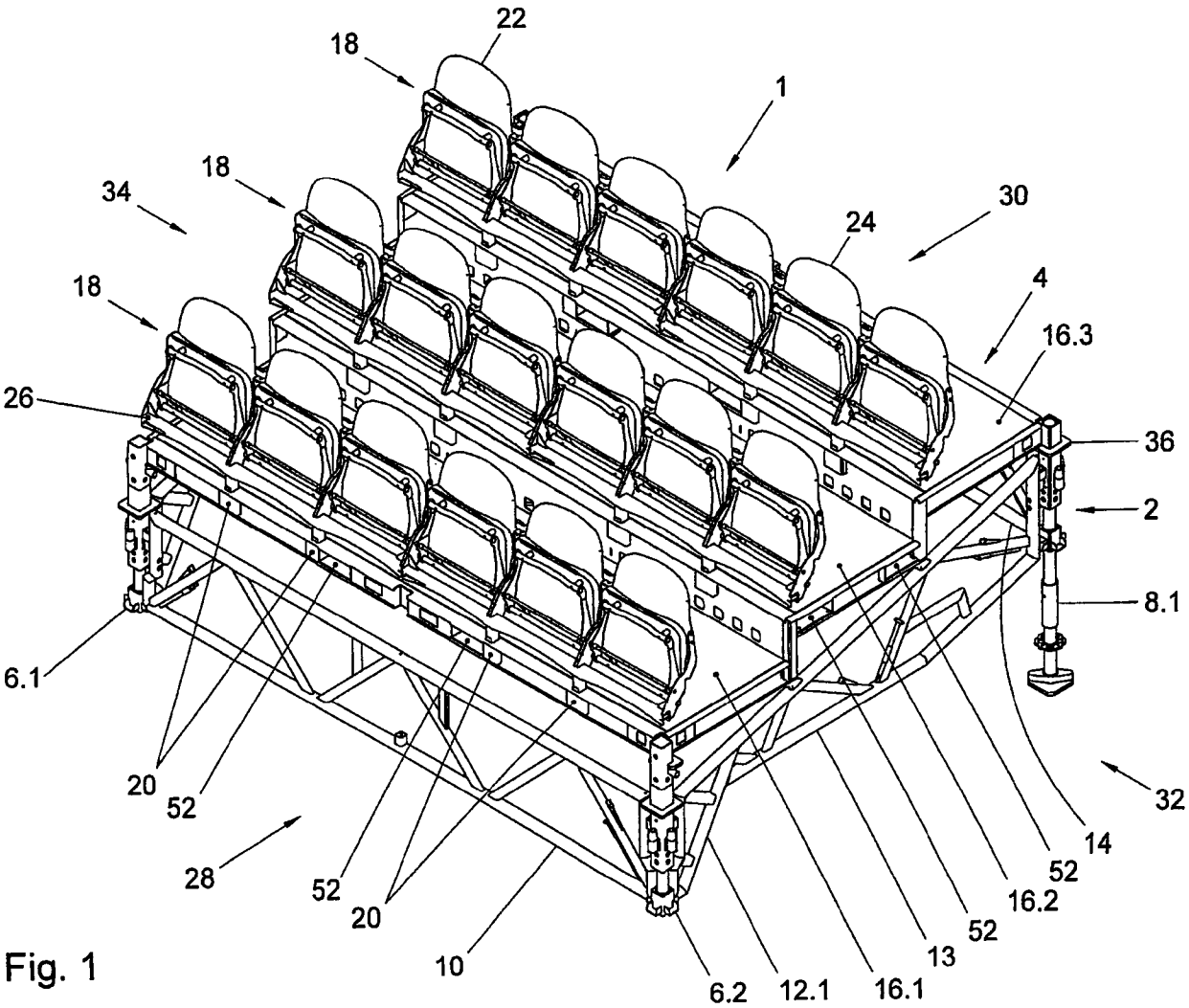

This application is a continuation of U.S. application Ser. No. 12/086,209, filed Oct. 8, 2008, now abandoned, which is a U.S. National Stage application under 35 U.S.C. 371 of International Application PCT/NL2006/000631 (published as WO 2007/067051 A1), filed Dec. 11, 2006, which claims priority to the following applications: EP 06075560.0, filed Mar. 9, 2006 and NL 1030641, filed Dec. 9, 2005. Benefit of the filing date of each of these prior applications is hereby claimed. Each of these prior applications is hereby incorporated by reference herein in its entirety.

The invention relates to a method for constructing a removable stand comprising constructing a support structure from posts and trusses that are positionable between the posts and positioning a floor element on the support structure.

The invention moreover relates to a removable stand comprising a support structure and a floor element, wherein the support structure comprises posts and trusses that are positionable between the posts and wherein, in use, the floor element is positioned on the support structure.

These kinds of removable stands are, in practice, mostly used in case of events during which a temporary stand is required to allow a plurality of spectators to see an event. Thereto the stand is provided with a plurality of rows of spaces, positioned behind each other and located at a distance in height, where the spectators can occupy a place. Substantially, of each two consecutive rows the rearmost row will, in height, be positioned higher than the foremost row to allow the spectators on the rearmost of the two rows to look over the heads of the spectators on the foremost row. The stands are, in general, provided with standings and/or seats to place the spectators.

This kind of method and removable stand are known per se. In a known method first a support structure is built of posts and trusses that are positionable between the posts. Subsequently for each row of standings and/or seats floor elements, such as wooden panels, are positioned on the support structure. If necessary, finally seats and/or benches are positioned on the support structure in the event seats are desired.

This known method and removable stand have the disadvantage that the construction and/or removal of this kind of removable stand takes up a lot of time, requires a lot of manpower and is relatively expensive.

It is an objective of the invention to provide a method and removable stand by means of which the removable stand can be constructed and/or removed faster and/or with less manpower.

According to a first aspect of the invention, thereto the method is characterised in that the floor element comprises a plurality of floor levels positioned behind each other and positioned at a distance in height. This offers the advantage that the floor element comprises a plurality of rows of standings and/or seats positioned behind each other, as a result of which, by means of positioning of the floor element on the support structure, a plurality of rows is positioned at once. It is, therefore, not necessary to separately position the floor elements per row. As a consequence the stand can be constructed faster and/or with less manpower.

A floor element forms, in the sense of the aspects of the invention, a single, preferably rigid, part of the removable stand, that is a part which can, in its entirety, be positioned on the support structure. In addition, a floor element in the sense of the aspects of the invention forms a part providing a floor surface onto which a spectator can safely stand or safely walk on, in case of standings as well as in case of seats. In connection herewith, in a view from above, the floor surface, preferably the entire surface of the stand on which the spectators can stand and/or sit, is covered (with the exception of small openings through which a foot and/or finger of a spectator can not reach). It will be appreciated that a narrow rod or post does not constitute a floor surface onto which a spectator can safely stand or walk.

In a special embodiment the floor element comprises three floor levels positioned behind each other and positioned at a distance in height. This offers the advantage that the floor element can be arranged so large that the stand can be constructed in a fast manner and that, simultaneously, the floor element can be so small that the floor element can be transported with regular means, such as a normal truck.

According to a second aspect of the invention the method is characterised in that the floor element, before it is positioned on the support structure, is provided with the at least one seat and/or bench. It will be clear that this seat and/or bench is connected to the floor element and the floor element to the support structure. This seat and/or bench is, in connection therewith, not directly connected to the support structure. This offers the advantage that the floor element can, for example near a stock of seats and/or benches, such as a pallet or container, be provided with the at least one seat and/or bench. As a consequence it is not necessary to separately transport the at least one seat and/or bench and the floor element to the location on the support structure where the floor element and the at least one seat and/or bench needs to be positioned, but can the at least one seat and/or bench be positioned on the floor element with less effort after which an assembly of the floor element and the at least one seat and/or bench can be transported to the location on the support structure where the floor element and the at least one seat and/or bench needs to be positioned. As a result hereof the stand can be constructed faster and/or with less manpower.

The terms seat and bench are understood to be a seat respectively a plurality of seats in general. A plurality of seats with an at least partially joint frame thus also constitutes a bench.

According to a third aspect of the invention the removable stand is characterised in that the floor element is provided with connection means for connecting thereto the at least one seat and/or bench. This offers the advantage that it is possible to provide the floor element with the at least one seat and/or bench before the floor element is positioned on the support structure in the event the at least one seat is desired and that the at least one seat and/or bench does not need to be positioned on the (at least partially constructed) support structure. It will be clear that the at least one seat and/or bench is, in connection herewith, connected to the floor element and the floor element is connected to the support structure, so that the at least one seat and/or bench is not directly connected to the support structure. Thus it is also possible to position the floor element without seats and/or benches in the event standings are desired.

The at least one seat and/or bench is, preferably, positioned on the floor element at a ground level. This offers the advantage that the floor element is properly accessible and that a user constructing the stand can position the at least one seat and/or bench in a safer manner than in the event the at least one seat and/or bench is positioned on a higher position on the floor element and/or the support structure.

The floor element is, preferably, positioned on the support structure by means of a hoisting device, such as a fork-lift truck or a hoisting crane.

Preferably, a post positioned, in use, at a front side of the floor element is lower than a post positioned, in use, at a rear side of the floor element. Preferably, in use, a first truss extending at a front side of the floor element is lower than a second truss extending at a rear side of the floor element. Preferably, in use, posts on the sides of the floor element extend slanting upwards in a direction from the front side of the floor element to the rear side of the floor element. This offers the advantage that the support structure forms a frame, onto which the floor element is positioned, provided with floor levels positioned behind each other and positioned at a distance in height.

In connection herewith the indication 'in use' refers to the constructed condition of the removable stand.

The floor element, preferably, comprises a stepped frame and a plurality of floor plates positioned at a distance in height. As a result hereof, in an easy manner, the floor element is provided with a plurality of floor levels positioned behind each other and positioned at a distance in height.

The floor element is, preferably, provided with hoisting facilities, such as hoisting eyes or loading buckets for housing the loaders of a hoisting device, such as a fork-lift truck, for placing the floor element on the support structure and/or for removing the floor element from the support structure. As a result hereof the floor element, possibly provided with the at least one seat and/or bench, can in an easy manner be positioned on the support structure by means of a known hoisting device.

The connection means for connecting the at least one seat and/or bench, preferably, comprise a sleeve placed on or in the floor element for, therein or thereto, installing the at least one seat and/or bench. As a result hereof the at least one seat and/or bench can, in an easy manner, be connected to the floor element.

A back of the at least one seat and/or bench is spaced backwards in relation to the connection means. As a result hereof under the at least one seat and/or bench additional legroom and/or foot room is created for a spectator occupying a seat and/or bench behind this seat and/or bench.

The stand, preferably, comprises of a plurality of floor elements. In use each floor element of the plurality of floor elements is, preferably, free from overlap any other floor element of the plurality of floor elements. Each floor element of the plurality of floor elements is, preferably, free from engagement with any other floor element of the plurality of floor elements. As a result hereof each floor element can be positioned on the support structure irrespective of neighbouring floor elements. Thus no predetermined sequence needs to be followed upon positioning of the floor elements on the support structure.

In use each floor element of the plurality of floor elements, preferably, substantially abuts sideways against the floor elements of the plurality of floor elements adjacent to that floor element. As a result hereof the adjacent floor elements, substantially, form an uninterrupted floor. This reduces the risk that a spectator, for example with a foot or finger, gets stuck between two floor elements. As a consequence it is not necessary to fill up a space between two adjacent floor elements with an additional adapter piece.

At least one floor element of the plurality of floor elements is, preferably, positioned over another floor element of the plurality of floor elements. This offers the advantage that above or below a first layer of standings or seats an additional layer of standings and/or seats and/or a platform can be created. As a result hereof the capacity of the stand, that is the number of standings and/or seats per square metre, increases.

The invention moreover relates to a floor element to be used in a removable stand. According to the first aspect of the invention the floor element is characterised in that the floor element comprises a plurality of floor levels positioned behind each other and positioned at a distance in height. According to the third aspect of the invention the floor element is characterised in that the floor element is provided with connection means for connecting thereto the at least one seat and/or bench.

The invention furthermore relates to a seat apparently suitable for use in a removable stand according to the invention.

Moreover the invention relates to a bench apparently suitable for use in a removable stand according to the invention.

Figure 2A:
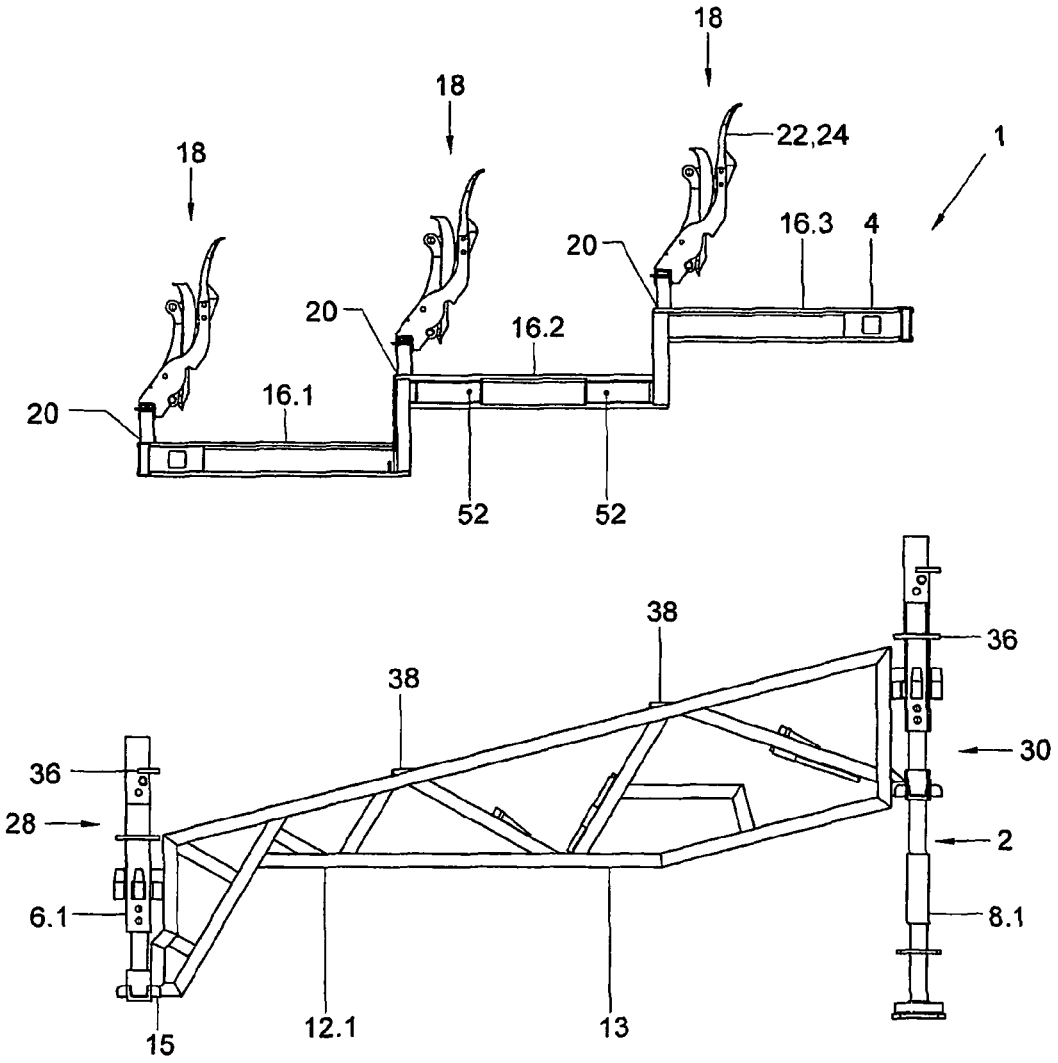
Figure 2B:
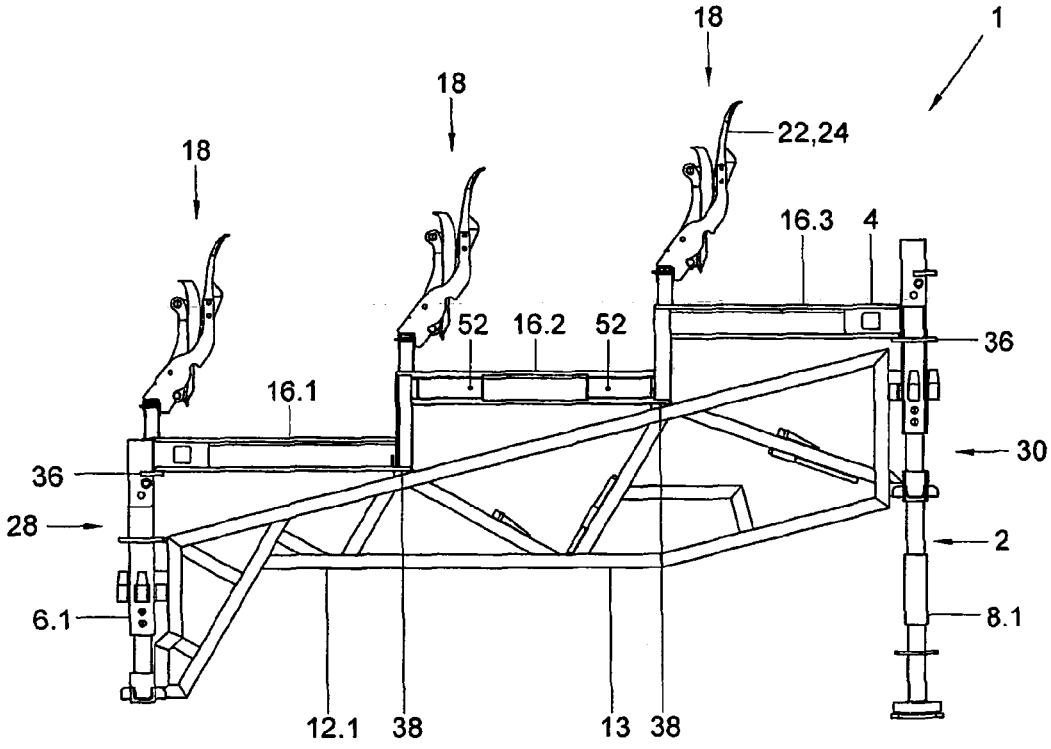
Figure 3A:
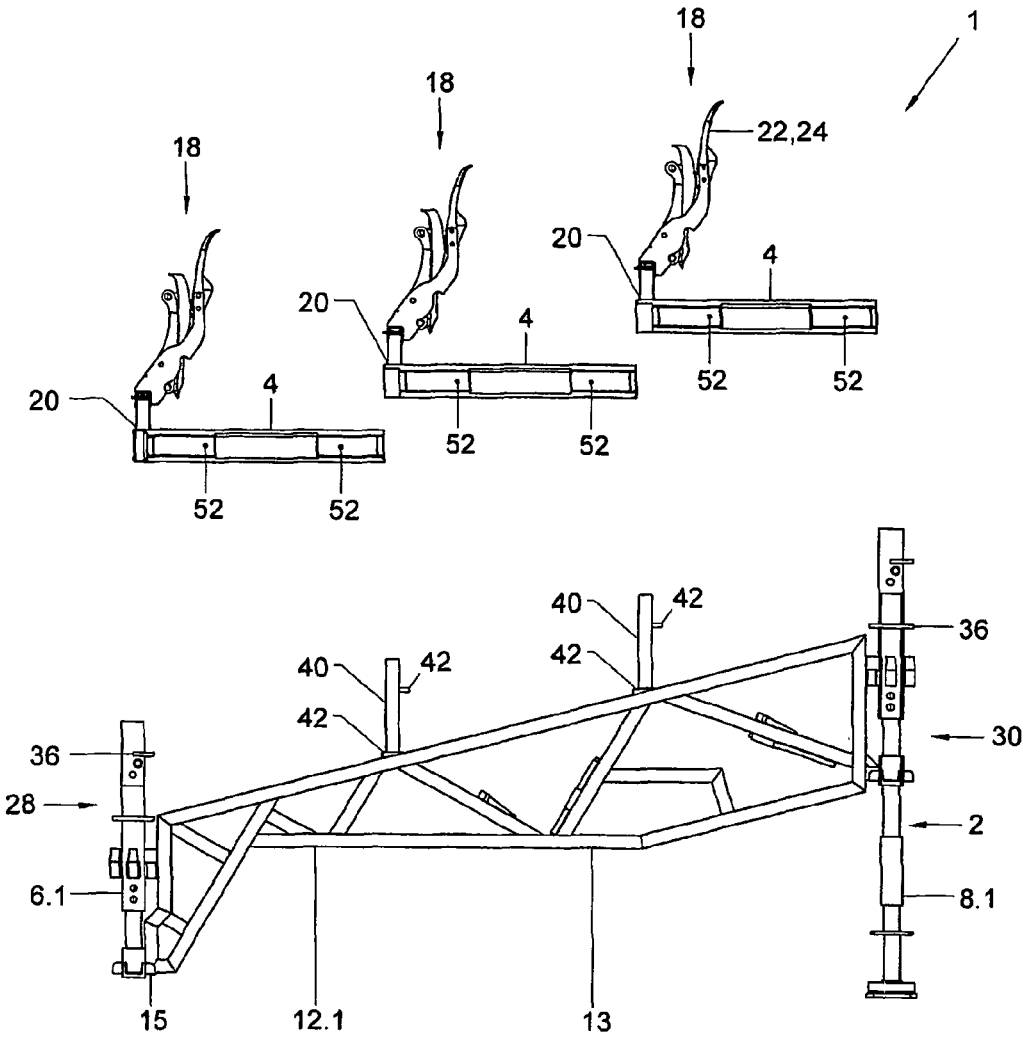
Figure 3B:
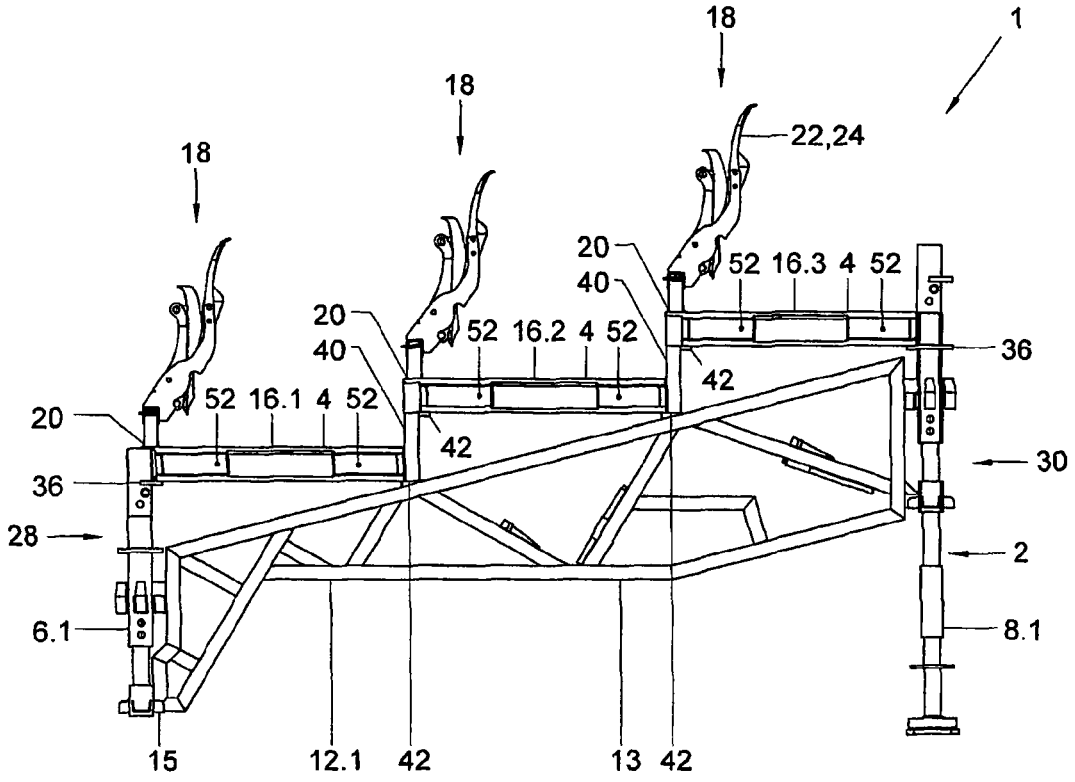
Figure 4A:
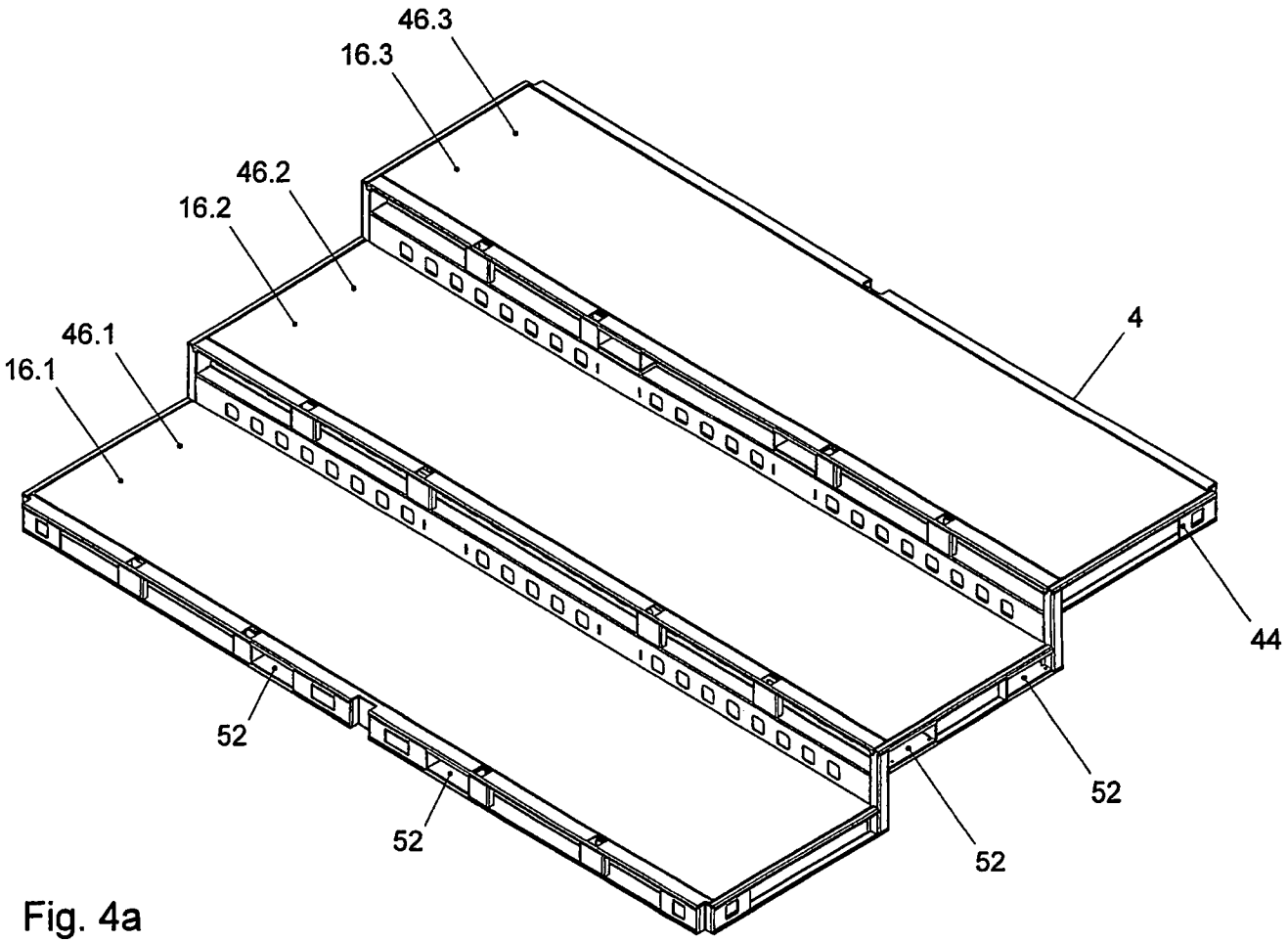

Hereinafter the invention is, by means of a non-limiting example, further elucidated on the basis of the drawing. Here FIG. 1 provides a schematic representation in perspective of a first embodiment of a removable stand according to the invention;

FIG. 2*a* provides a side-view of the removable stand demonstrated by FIG. 1 wherein the floor element is not positioned on the support structure;

FIG. 2*b* provides a side-view of the removable stand demonstrated by FIG. 1 wherein the floor element is positioned on the support structure;

FIG. 3*a* provides a side-view of a second embodiment of a removable stand according to the invention wherein the floor elements are not positioned on the support structure;

FIG. 3*b* provides a side-view of a second embodiment of a removable stand according to the invention wherein the floor elements are positioned on the support structure;

FIG. 4*a* provides a perspective view from above of the floor element of the stand demonstrated in FIGS. 1, 2*a* and 2*b;*

Figure 4B:
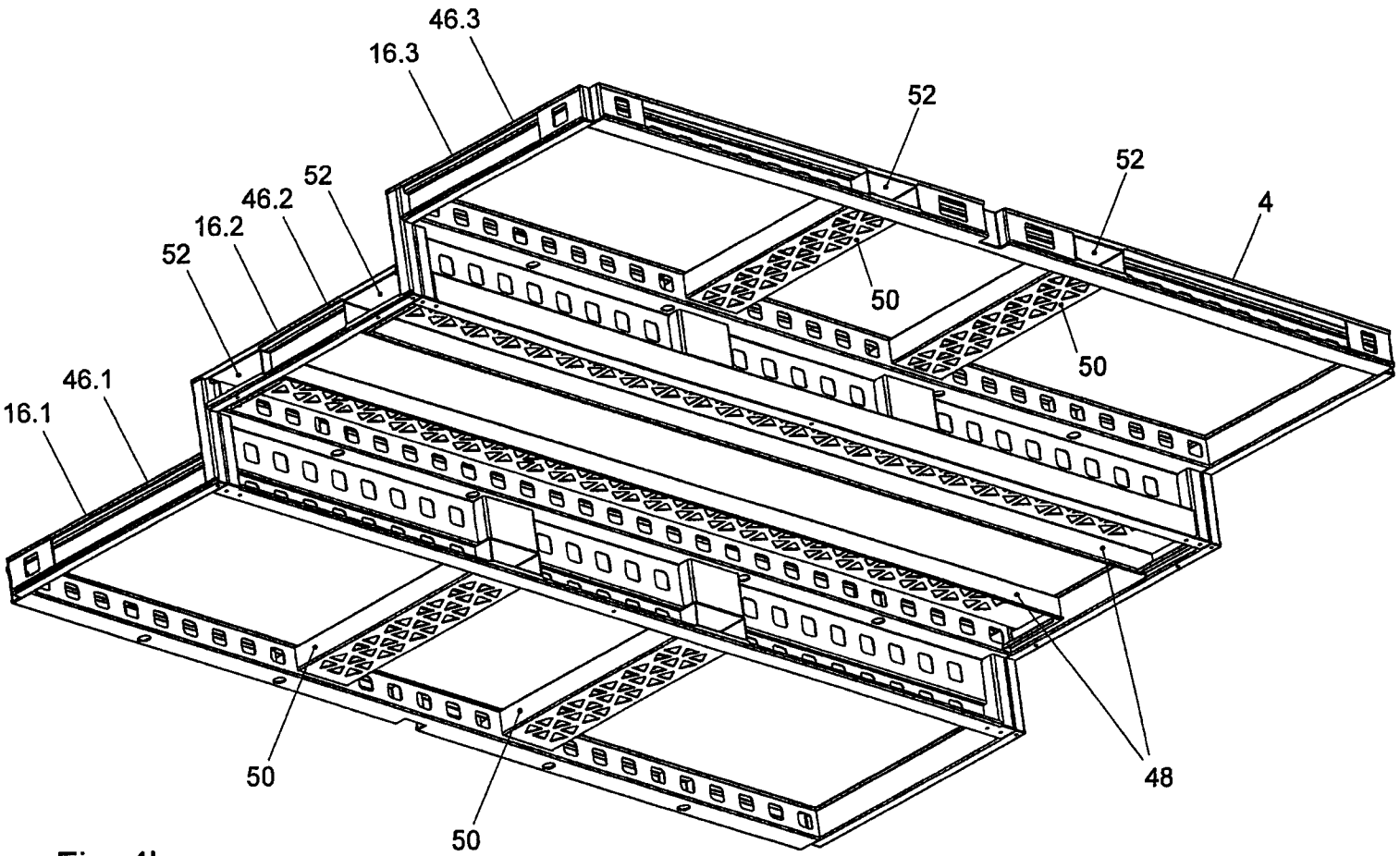

FIG. 4*b* provides a perspective view from below of the floor element of the stand demonstrated in FIGS. 1, 2*a* and 2*b;*

Figure 5A:
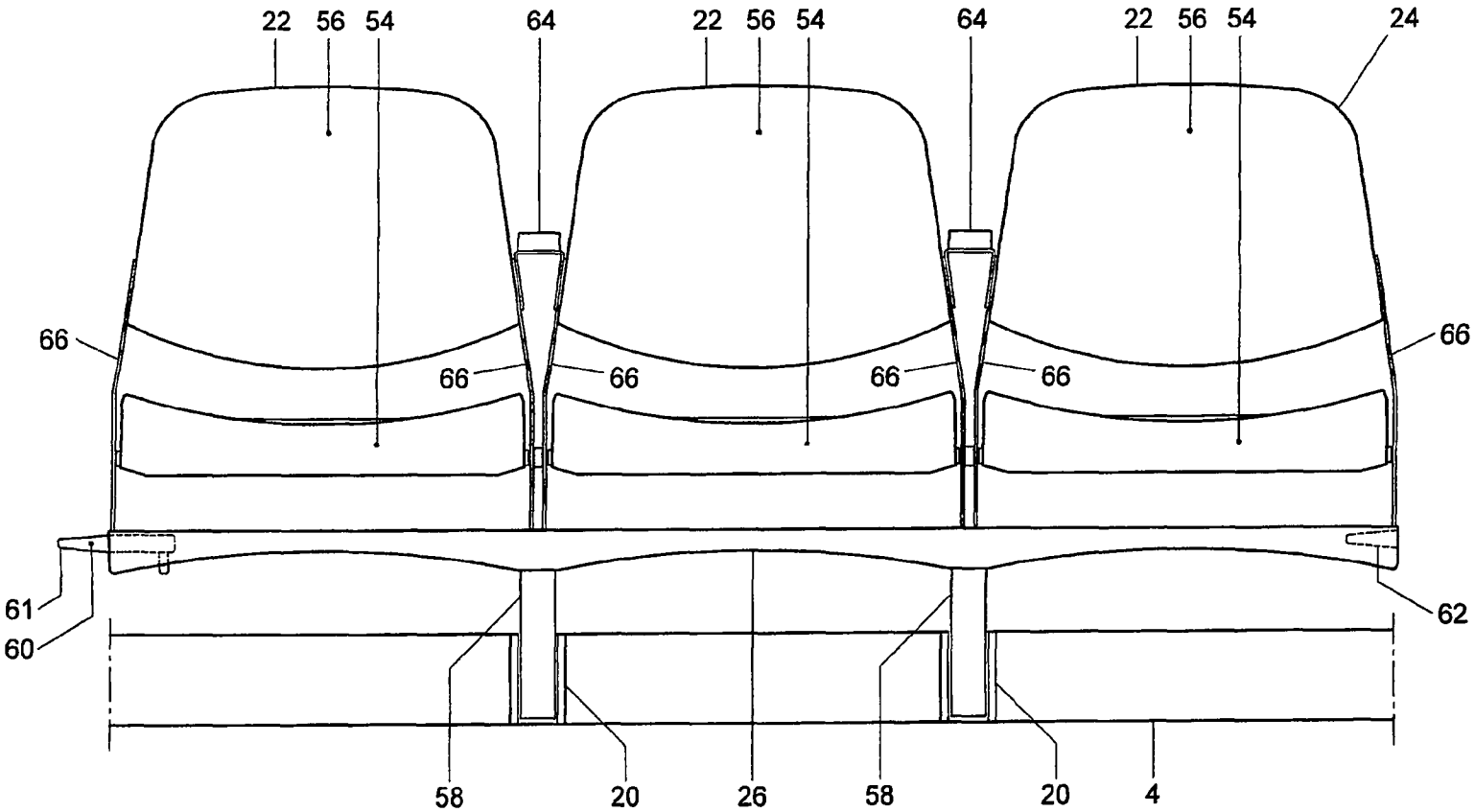
Figure 5B:
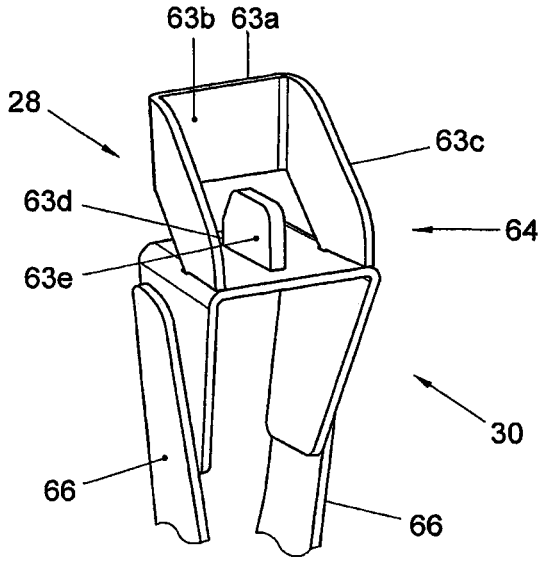
Figure 6A:
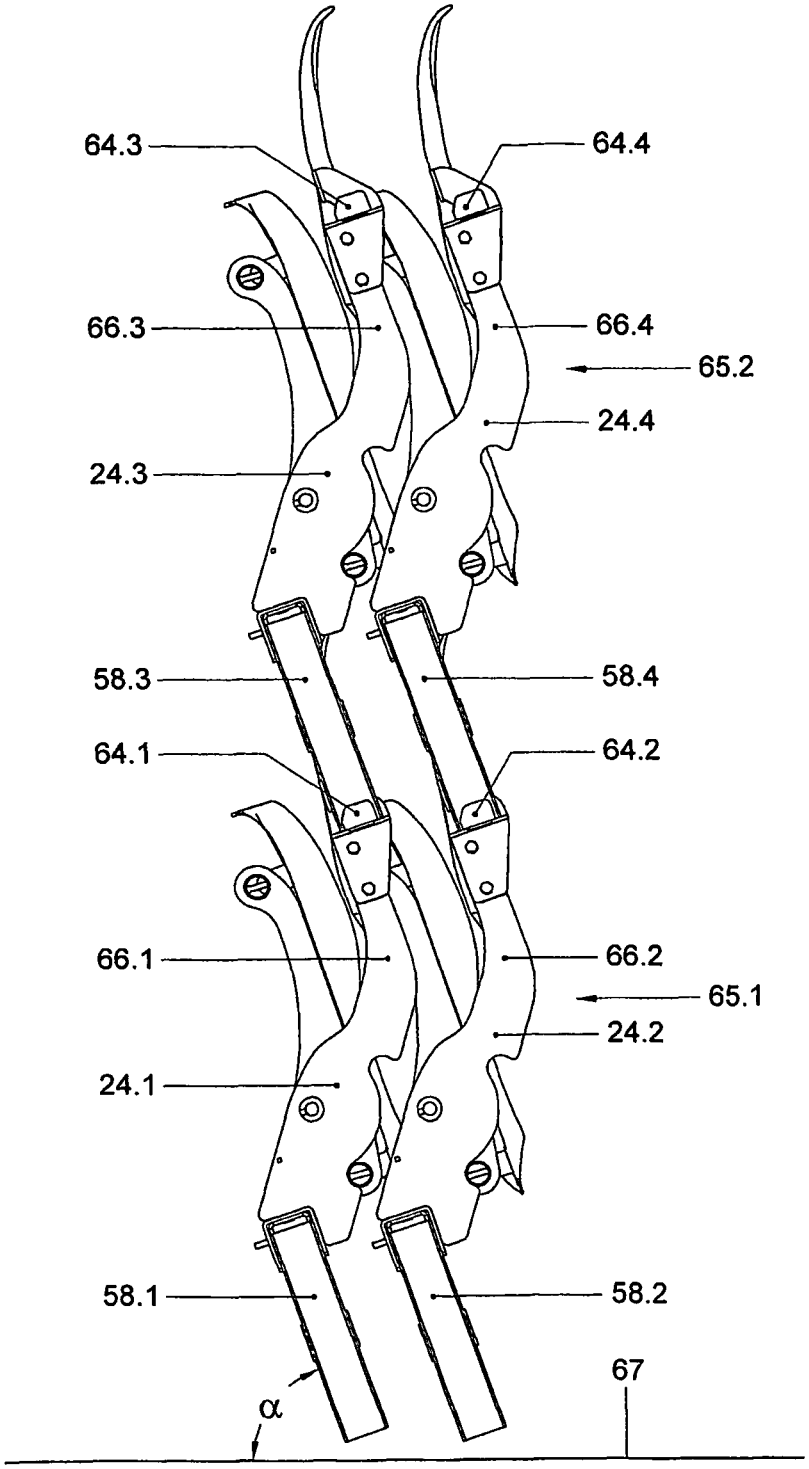
Figure 6B:
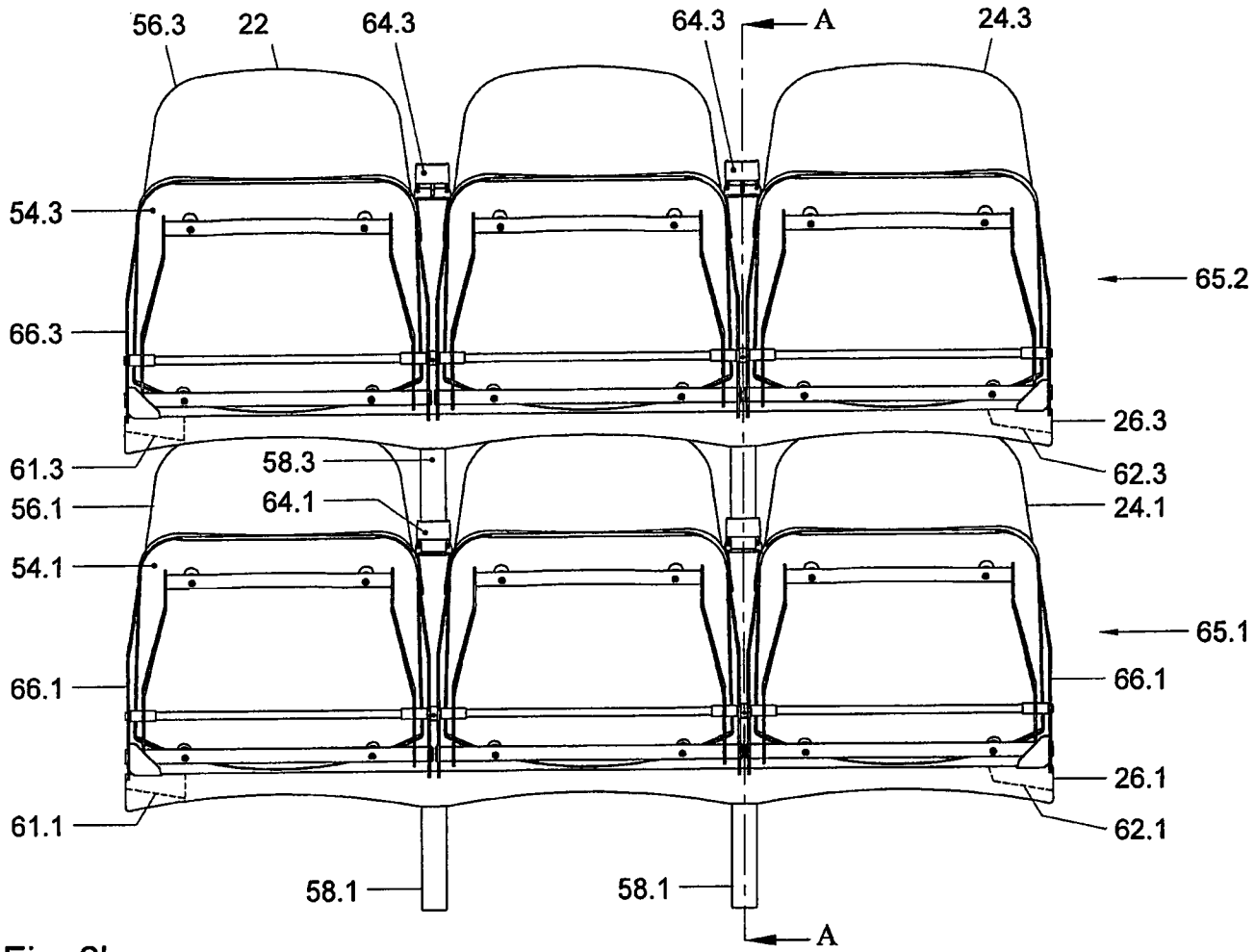
Figure 7:
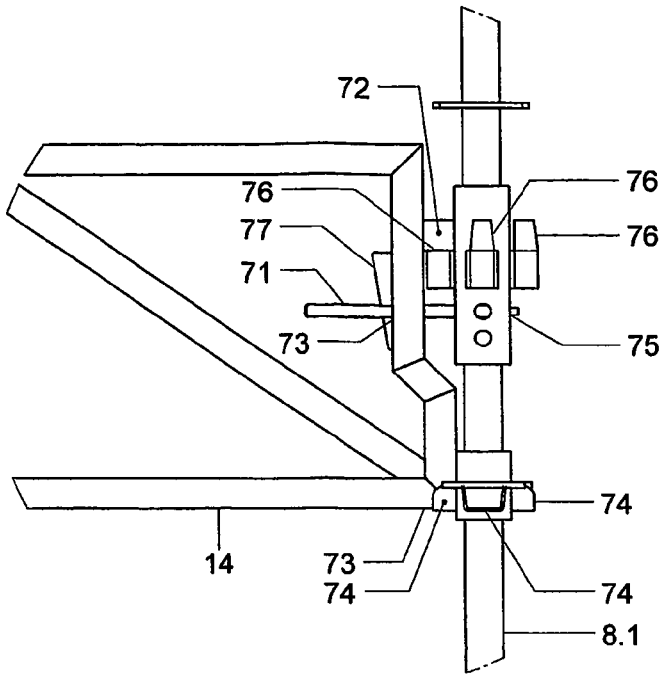
Figure 8:
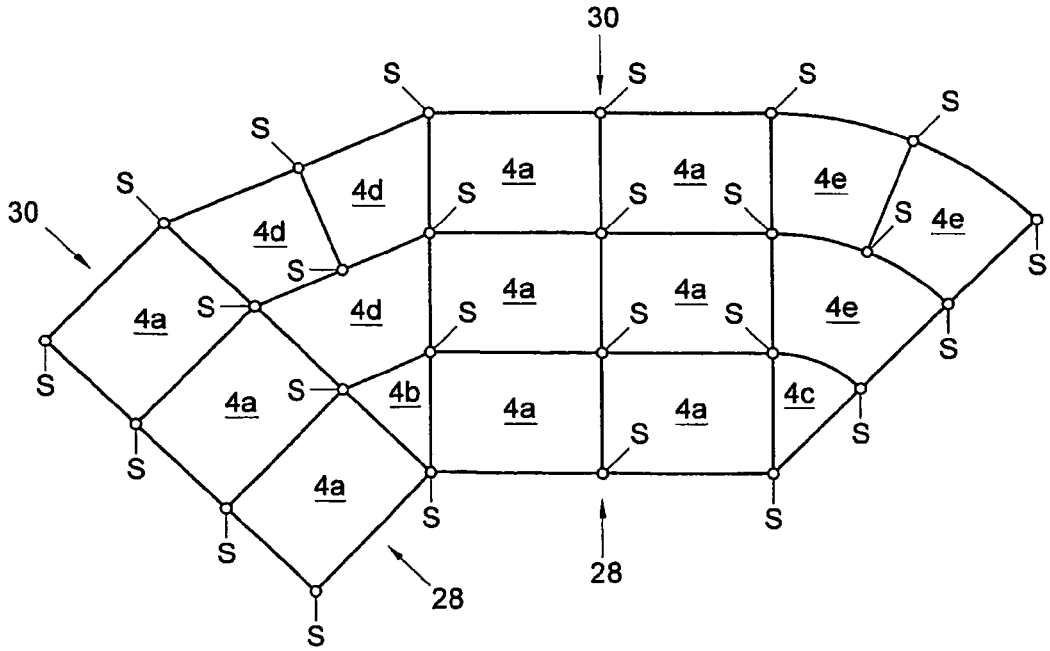
Figure 9:
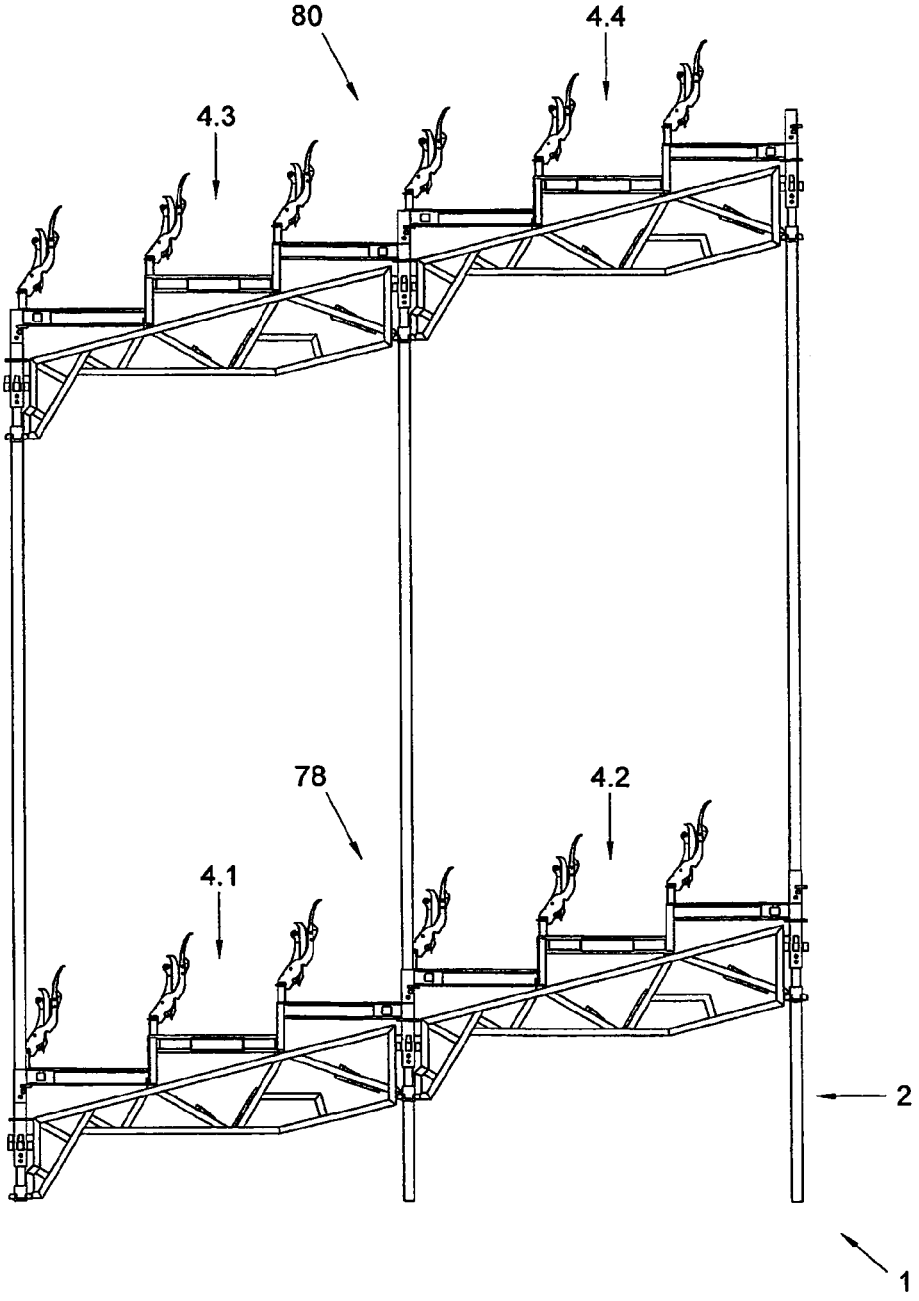

FIG. 5*a* provides an example of an embodiment of a bench of a stand according to the invention;

FIG. 5*b* provides an alternative embodiment of the piling element in perspective slanting rear-view;

FIGS. 6*a* and 6*b* provide an example of a pile of a plurality of benches;

FIG. 7 provides a schematic representation of a detail of the support structure of the stand according to the invention;

FIG. 8 provides a schematic view from above of a removable stand according to the invention; and FIG. 9 provides a schematic representation of a third embodiment of a removable stand according to the invention.

FIG. 1 provides a schematic representation in perspective of an embodiment of a removable stand according to the invention in a constructed condition. In FIG. 1 the removable stand 1 comprises a support structure 2 and a floor element 4. In this example the floor element 4 forms a single piece of the stand. The support structure 2 comprises posts 6.*i* (i=1, 2, 3, . . . ), 8.*i* (i=1, 2, 3, . . . ) and, in the constructed condition, demonstrated in FIG. 1, trusses 10. 12.*j* (j=1, 2, 3, . . . ), 14 positioned between the posts. In use, that is in the constructed condition, the floor element 4 is positioned on the support structure 2.

In the example the floor element 4 comprises a plurality of floor levels 16.*k* (k=1, 2, 3, . . . ) positioned, in the constructed condition, behind each other and positioned at a distance in height. In FIG. 1 the floor element 4 comprises three floor levels 16.1, 16.2, 16.3 positioned behind each other and positioned at a distance in height.

The floor levels 16.*k* of the floor element 4 constitute a floor surface onto which the spectator can safely stand and/or can safely walk. In FIG. 1 the floor surface of each floor level 16.*k* is completely closed and, in the view from above, the separate floor surfaces of the floor levels 16.*k* adjoin. It will be clear that the floor surface can further be provided with openings, for example to let precipitation through, sufficiently small not to jeopardise the safety of the spectator. In connection therewith the openings are, preferably, sufficiently small so that a foot and/or finger of a spectator can not reach through an opening.

The floor element has, preferably, such dimensions that the floor element can be transported by means of regular means, such as a regular truck, and that the stand can be constructed in a fast manner. In connection therewith the floor element is, preferably, less than 16 meters wide from a first side 32 to a second side 34 of the floor element. The floor element is, preferably, wider than 1.4 meters. The floor element is, preferably, less than 4 meters deep from a front side 28 to a rear side 30 of the floor element. The floor element is, preferably, deeper than 0.7 meters. Preferably, the floor element is substantially 3 meters wide and 2.25 meters deep. This offers the advantage that the floor element can comprise 3 floor levels positioned behind each other of, substantially, 0.75 meters deep which constitutes a favourable dimension for a seat and/or standing.

In FIG. 1 each floor level 16.*k* forms a row 18 on which standings and/or seats are provided. In FIG. 1 the stand 1 is consequently provided with a plurality of rows 18 of locations where the spectators can occupy a place positioned behind each other and positioned at a distance in height. Of each two consecutive rows 18 the rearmost row is, in height, positioned higher than the foremost row to allow the spectators on the rearmost of the two rows to look over the heads of the spectators on the foremost of the two rows 18, for example at an event.

The removable stand 1 described up to now can, to obtain standings, be constructed by means of the following method. First of all the posts 6.*i*, 8.*i* are connected by means of the trusses 10, 12.*j*, 14 for creating the support structure 2. Subsequently the floor element 4, comprising a plurality of floor levels 16.*k* positioned behind each other and positioned at a distance in height, is positioned on the support structure 2. The floor levels 16.*k* form the standings. It will be clear that, as a result of positioning the floor element 4, which comprises of a plurality of floor levels 16.*k* positioned behind each other and positioned at a distance in height, consequently a plurality of rows 18 with standings is, simultaneously, positioned on the support structure 2. As a result hereof the stand 1 can be constructed faster and/or with less manpower than in case the rows 18 with standings are positioned on the support structure 2 separately.

In the example of FIG. 1 the floor element 4 is, moreover, provided with connection means 20. The connection means 20 are arranged for connecting thereto the at least one seat 22 and/or bench 24. In this example a bench 24 is formed by an assembly of three seats 22 on a mutual frame 26. The connection means 20 in this example are, further, arranged for removably connecting the seats 22 and/or benches 24 to the floor element 4.

The removable stand 1 described up to now can, to obtain seats, be constructed by means of the following method. First of all the posts 6.*i*, 8.*i* are connected by means of the trusses 10, 12.*j*, 14 for creating the support structure 2. Subsequently the floor element 4 is provided with seats 22 and/or benches 24. Hereto the seats 22 and/or benches 24 are connected to the connection means 20 of the floor element 4. The seats 22 and/or benches 24 are, preferably, positioned on the floor element 4 at a ground level. The ground level can, for example, be an underground onto which stand 1 is constructed. This offers the advantage that the floor element 4 is properly accessible and that a user constructing the stand 1 can position the seats 22 and/or benches 24 on the floor element 4 in a safer manner than in the event the seats 22 and/or benches 24 are positioned on the floor element 4 and/or the support structure 2, for example, on a high and/or insufficiently flat and/or difficult in walkable position such as, for example, on the support structure 2.

It will be clear that the floor element 4 can also be positioned on a platform, such as a trestle or hoisting device, at the ground level to set the floor element 4 at a favourable height to position the seats 22 and/or benches 24 onto the floor element 4, for example at an ergonomic height such as a height at which the back of the user positioning the seats 22 and/or benches 24 on the floor element 4 is, as little as possible, burdened. It will moreover be clear that, under circumstances, the ground level can be at a level above or below the underground. The ground level can in that case, for example, be constituted by a platform, dais or (flat) roof.

Finally, the floor element 4, provided with the seats 22 and/or benches 24, is positioned on the support structure 2. It will be clear that seats 22 and/or benches 24 are then connected to the floor element 4 and that the floor element 4 is connected to the support structure 2. The seats 22 and/or benches 24 are consequently not directly connected to the support structure 2.

It will be clear that, as a result of positioning of the floor element 4, provided with the seats 22 and/or benches 24, the stand can be constructed faster and/or with less manpower than in the event the floor element 4 is first positioned on the support structure and the stand is subsequently provided with the seats 22 and/or benches 24. It may furthermore be clear that, as elucidated here below with reference to FIGS. 3*a* and 3*b*, as a result of positioning of the floor element 4 provided with the seats 22 and/or benches 24, where the floor element only comprises one row 18 with seats, the stand 1 can already be constructed faster and/or with less manpower than in the event the floor element 4 is first be positioned on the support structure and the stand is subsequently provided with the seats 22 and/or benches 24.

In the example of FIG. 1 the seats 22 and/or benches 24 are connected to only one floor element 4. For that purpose, the seats 22 and/or benches 24 are, in use, free from connections to, for example, neighbouring, floor elements and/or the support structure 2. The connection means 20 for connecting a seat 22 and/or bench 24 to the floor element 4 are consequently all fully located at or in the relevant floor element 4. This offers the advantage that the seats 22 and/or benches 24 that are, in the constructed condition to be positioned on a predetermined floor element 4 are only, connected to that floor element 4 and can consequently be connected to that floor element 4 before floor element 4 is positioned on the support structure 2.

In the example of FIG. 1 the floor element 4 has, in a view from above, a substantially rectangular circumference. In FIG. 1 the support structure 2 is, at each corner of the floor element 4, provided with a post 6.*i*, 8.*i* and adjacent each side of the floor element 4 provided with a truss 10, 12.*j*, 14. Thus the support structure constitutes a framework onto which, during use, the floor element 4 is positioned. With respect to the example applies that the posts 6.*i* located, in the constructed condition, at the front side of the floor element 4 are lower than the posts 8.*i* located at the rear side 30 of the floor element 4. With respect to the example furthermore applies that in the demonstrated constructed condition a first truss 10 extending along the front side 28 of the floor element 4 is located lower than a second truss 14 extending along the rear side 30 of the floor element 4. With respect to the embodiment of FIG. 1 moreover applies that the trusses 12.*j*, extending at the left and right side 32, 34 of the floor element 4, extend slanting upwards in a direction from the front side 28 of the floor element 4 to the rear side 30 of the floor element 4.

Optionally, it is possible that the foremost floor element 4 of the stand 1 at the front side 28 rests on the underground. In that case it is not necessary that a truss 10 and/or posts 6.*i* is positioned at the front side 28 of the foremost floor element 4. It is also possible that the foremost floor element at the front side 28 rests on, for example differently arranged, lateral trusses. The foremost floor element can, for example, also be placed on blocks at the front side 28.

FIGS. 2*a* and 2*b* demonstrate a side-view of the removable stand 1 demonstrated in FIG. 1. In FIG. 2*b* the floor element 4 is positioned on the support structure 2. In FIG. 2*a* the floor element 4 is not positioned on the support structure 2. In the example of FIGS. 1, 2*a* and 2*b* the floor element 4 is connected to two trusses, namely trusses 12.*j* that extend to the sides 32, 34 of the floor element 4. In this example the floor element 4 rests on the two trusses 12.*j*. In the example of FIGS. 1, 2*a* and 2*b* the floor element 4 is also connected to the posts 6.*i*, 8.*i*. In this example the floor element 4 rests on a flange 36 of each of the posts 6.*i*, 8.*i*. In FIGS. 2*a* and 2*b* it can be seen that the trusses 12.*j* which, in use, extend at the sides 32, 34 of the floor element 4, are provided with support areas 38 for, in the constructed condition, supporting the floor element 4. In this example the support areas 38 on the trusses 12.*j* substantially extend into a horizontal direction.

The floor element is, preferably, at least rigid to such extent that it is able to support its own weight and the weight of possibly positioned seats and/or benches whilst the floor element is being positioned on the support structure. This offers the advantage that, during the construction of the stand 1, the floor element is auto-supportive and no auxiliary means are required for enhancing the rigidity of the floor element during the positioning. In connection herewith it is possible that, in the constructed condition, the rigidity of the floor element is also determined by the rigidity of the support structure. Thus, this offers the advantage that the floor element not necessarily needs to be designed in such rigid manner that the floor element necessarily has sufficient rigidity to support the spectators and/or to comply with (safety) standards. As a result hereof the floor element per se can be designed in a less rigid and thus lighter and/or cheaper manner.

FIGS. 3*a* and 3*b* demonstrate a side-view of a second embodiment of a removable stand according to the invention. In FIGS. 3*a* and 3*b* the removable stand 1 comprises of a support structure 2 and a plurality of, in this example three, floor elements 4. The support structure 1 comprises posts 6.*i*, 8.*i* and, in the constructed condition demonstrated in FIGS. 3*a* and 3*b*, trusses 10, 12.*j*, 14 positioned between the posts. In the example of FIG. 3*b* the plurality of floor elements 4 forms the plurality of floor levels 16.*k* positioned behind each other and positioned at a distance in height.

In FIGS. 3*a* and 3*b* the support structure 2 is further provided with supports 40 for connecting thereto the floor elements 4. In this example the supports 40 are provided with support areas 42 for supporting the floor elements 4. The supports 40 may be designed as posts at the upper side of the trusses 12.*j* which posts may, for example, be removably connected to truss 12.*j*. The supports 40 could, however, also be executed as, for example, trusses removably connected to the trusses 12.*j* that extend into a direction substantially parallel to truss 10 and/or truss 14 between trusses 12.*j*. The supports 40 that, in a constructed condition, are connected to one of the trusses 12.*j* can also be inter-connected into an assembly of supports 40 which can removably be connected to the relevant truss 12.*j*.

In FIG. 3*b* the floor elements 4 are positioned on the support structure 2. In FIG. 3*a* the floor elements 4 are not positioned on the support structure 2. It will be clear that, as a result of positioning of the floor element 4 provided with the seats 22 and/or benches 24, wherein floor element 4 only comprises one row 18 with seats, the stand 1 can already be constructed in a faster manner and/or with less manpower than in the event floor element 4 is first positioned on the support structure and subsequently the stand is provided with seats 22 and/or benches 24.

FIGS. 4*a* and 4*b* respectively demonstrate a perspective view from above and a perspective view from below of the floor element 4 of the stand 1 demonstrated in FIGS. 1, 2*a* and 2*b*. In FIGS. 4*a* and 4*b* the floor element 4 comprises three floor levels 16.1, 16.2, 16.3 positioned behind each other and positioned at a distance in height. The floor element 4 comprises a frame 44, in the example a stepped frame, and a plurality of floor plates 46.*k* positioned at a distance in height, in this example three floor plates 46.*k*.

The frame 44 can, for example, be manufactured of bent metal plate and/or comprise profiles, such as U-profiles, C-profiles, Z-profiles and/or tubes and/or cylinders. In FIG. 4*b* it is demonstrated that the frame 44 comprises U-profiles 48 that extend in a width direction of the floor element 4 and U-profiles 50 that extend in a depth direction of the floor element 4. In the example the floor plates 46.*k* are manufactured of plate material such as metal, wood and/or plastic.

In FIGS. 4*a* and 4*b* it is further demonstrated that the floor element 4 is provided with loading buckets 52. During the construction and/or removal of the removable stand 1 the loaders, for example of a fork-lift truck and/or loading block of a hoisting crane, can be positioned in the loading buckets 52. Thus the floor element 4, whether or not provided with seats 22 and/or benches 24, can easily be positioned on the support structure 2 or can easily be removed from the support structure 2. In the embodiment of FIG. 4*b* the loading buckets 52 extend in the floor element 4 within the U-profiles 48, 50.

The floor element 4 can further be provided with profiles that serve as the connection means 20. Thereto the profiles can be created for having the at least one seat and/or bench installed in or on it. Each profile can, for example, be arranged for having a leg of the at least one seat and/or bench installed in or on it.

In the examples of FIGS. 1, 2*a*, 2*b*, 3*a* and 3*b* the seats 22 are each provided with a foldable seat area 54. In these examples the seats 22 are each provided with a resilient element, for example a return spring, pressure spring or elastic element for folding up the seat area in the event there is no spectator on the seat. It is, however, also possible that the seats are arranged for folding up as a result of gravity in the event there are no spectators on the seats. Folding of the seat area increases the space between two rows of seats, for example to walk, in the event there are no spectators on the seats, furthermore the folding prevents that the seat area gets excessively wet and/or dirty in the event there is no spectator on the seat. It may be clear that also a bench, not arranged as a plurality of seats, can be provided with a foldable seat area.

In the examples of FIGS. 1, 2*a*, 2*b*, 3*a* and 3*b* a back 56 of each seat and/or bench is spaced backwards in relation to the connection means 20. As a consequence the seat area 54 sticks, at least partially, out backwards over the connection means 20. As a result hereof additional room is created for the feet and/or legs of a spectator occupying a seat and/or bench positioned behind the relevant seat and/or bench. This additional room is thus, at least partially, located under the seat area of the relevant seat and/or bench.

FIG. 5*a* demonstrates an example of bench 24 of the stand 1 according to the invention. In this example the bench 24 comprises a plurality of, in particular three, seats 22 each provided with a foldable seat area 54. In FIG. 5*a* the seat areas 54 are demonstrated in the downward position, ready to be sat on. The seats 22 are connected by means of the common frame 26. Thus the bench 24 is equipped with the frame 26. In this example a leg 58 substantially extend in a plane that extends substantially perpendicular to the back 56 and substantially perpendicular to the seat area 54 of a seat 22 and substantially does not intersect the back 56 and the seat area 54 of that seat 22. As a consequence the leg is, in the view from above, substantially positioned outside a circumference of the back 56 and the seat area 54. As elucidated by means of FIGS. 6*a* and 6*b* this offers the advantage that the seats and/or benches can be piled in a compact manner. In FIG. 5*a* the frame 26 is provided with two legs 58. In this example each leg 58 substantially extends into a plane that extends in between two neighbouring backs 56 and seat areas 54 of the seats 22 of the bench 26. In the example of FIGS. 5*a*, 6*a* and 6*b* the backs 56 of the benches 25 are spaced backwards in relation to the legs 58. The legs 58 are in this example designed as metal profiles, for example sleeve profiles with a substantially rectangular or square cross-section. In FIG. 5*a* the bench 24 is connected to the floor element 4 by means of connection means 20. In this example the connection means 20 are designated as metal profiles. In this example an internal dimension and possible form of the connection means 20 corresponds, at least partially, with an external dimension and possible form of the legs 58. The legs 58 in this example are, at least partially, inserted into the connection means 20.

In FIG. 5*a* the bench 24 comprises a plurality of seats 22. It will be clear that the bench can also be provided with a seat area providing a plurality of seat areas. In connection therewith this bench can be provided with a back. This bench is, preferably, provided with legs, whether or not removably connected to the bench, for connecting this bench to the floor element.

If desired, the legs 58 can be locked to the floor element 4, for example by means of a bolt, pin, wedge or the like. It is also possible to mutually connect benches 24 positioned next to each other by means of coupling means. The coupling means can, for example, comprise a pin 60 which is slidingly included in or on the frame 26. It is also possible that the pin 60 is designed as a profile, for example a U-profile. The pin 60 can, for example, be slided in the direction of the centre of the bench 24 and slided out in the opposite direction. In the event two benches 24 are positioned next to each other the pin 60 can in that case be slided from one bench to the other and, for example, fall into an opening 62 of the other bench. As a consequence the assembly of connected benches 24 constitutes a whole and contributes, for example, to the rigidity of the stand 1. It will be clear that it is also possible to connect benches 24 positioned on adjacent floor elements. In connection herewith it is not necessary to connect the adjacently positioned floor elements. It will further be clear that separate seats 22, in a similar manner as described here above in respect of the bench 24, can be connected to the floor element and, if desired, can be connected to a seat 22 and/or bench 24 positioned next to the seat 22.

In a special embodiment the coupling means are designed in such manner that they can exclusively be decoupled by means of a piece of equipment and possibly exclusively be coupled by means of a piece of equipment. As a result hereof it is prevented that spectators, consciously or unconsciously, decouple coupled benches and/or seats. Hereto, the pin 60 is, for example, slindingly included on or in the frame 26, wherein a friction force active in the sliding direction, in a coupled and/or decoupled condition, is predetermined such that the pin 60 cannot, at least barely, be slided manually. In connection therewith the friction force is, for example, predetermined such that the pin 60 can be slided by means of a piece of equipment, such as a hammer. In the example of FIG. 5*a* the pin 60 is provided with a tapered end 61 which, in the coupled condition, is blocked in the, in this example at least partially tapered, hole 62 of the neighbouring bench. It will be clear that the pin designed as a profile can also be designed in a tapered manner. A vertical angle of the tapered end 61 and the tapered hole 62 determined such that the coupling means can exclusively be decoupled by means of a piece of equipment and possible exclusively be coupled by means of the piece of equipment. Optionally, the pin 60 is designed in a wedge-shaped manner.

The frame 26 of the bench 24 is in FIG. 5*a* further provided with piling elements 64. In this example each piling element extends in a plane which a leg 58 of the bench 24 extends. In FIG. 5*a* the piling elements 64 are designed as profiles, for example metal sleeve profiles or tubes, substantially extending in between the backs 56 of the seats 22 of the bench 24. The piling element substantially extends in a plane in which the back positioned next tot the piling element extends. More in particular, the piling element extends in between two backs, in a plane formed by the two backs positioned next to each other. As a result hereof the chance that a spectator and/or user hurts himself/herself and/or an object gets damaged by the piling element is reduced. The function of the piling elements 64 is further elucidated on the basis of FIGS. 6*a* and 6*b*.

In the example of FIG. 5*a* the piling elements 64 are connected to brackets 66 for connecting the backs 56 to the frame 26. The piling elements 64 of a bench 24 are arranged for connecting the legs 58 of another bench 24 for creating a pileable assembly of benches, for example for obtaining a compact pile during storage and/or transportation of the benches. The piling elements 64 can, for example, comprise a profile for connecting the legs 58 thereto. In the example each piling element 64 comprises a tube for attaching the sleeve-shaped leg 58 thereto. In this example an internal dimension and possibly shape of the legs 58 corresponds with an external dimension and possibly shape of the piling elements 64.

FIG. 5*b* demonstrates an alternative embodiment of the piling element 64 in perspective slanting rear-view. In FIG. 5*b* the piling element comprises a first support point, in this example constituted by the upper edge 63*a* of a first lip 63*b* which extends at the front side of the piling element. In this example the first lip 63*b* forms part of a U-shaped housing 63*c* extending at the sides and the front side of the piling element 64. In FIG. 5*b* the piling element further comprises a second support point, in this example constituted by the front edge 63*d* of a second lip 63*e*. In the event benches 24 are piled an end of a leg 58 of the upper of the two benches 24 supports against the first and second support points of the piling element of the lower of the two benches 24. Hereto, for example, a leg 58, designed as a sleeve or a U-profile, is inserted into the U-shaped housing 63*c* and placed over the second lip 63*e* in such manner that the leg touches the first and the second support point. Since, as described hereunder in relation to FIG. 6*a*, the piled benches 24 preferably lean over forward, the leg 58 of the upper of the two benches abuts, as a result of gravity, against the first and the second support point so that a solid pile is obtained.

FIG. 6*b* demonstrates a frontal view of a plurality of benches 24 in a compact pile, for example during transportation and/or storage. FIG. 6*a* demonstrates a cross-section along the A-A line of the plurality of benches demonstrated in FIG. 6*b*. The compact pile can, for example, also be used to store benches 24 on a pallet or in a container. In the compact pile a plurality of benches 24.1, 24.2 positioned behind each other constitutes the first pile layer 65.1. On top of the first pile layer 65.1 a second pile layer 65.2 is placed comprising a plurality of benches 24.3, 24.4 positioned behind each other. In this example of each bench 24.3, 24.4 of the second pile layer 65.2 the legs 58.3, 58.4 are connected to the piling elements 64.1, 64.2 of the bench 24.1, 24.2 positioned under this bench 24.3, 24.4. In this example the legs 58.3, 58.4 of the benches 24.3, 24.4 in the second pile layer substantially extend between the backs 56.1, 56.2 of the benches 24.1, 24.2 of the first pile layer 65.1 Each piling element 64.*i* (i=1, 2, 3, . . . ) of a bench 24.*i* extends substantially parallel to a leg 58.*i* of that bench 24.*i* in a direction opposite the direction to which that leg 58.*i* extends. This offers the advantage that a plurality of benches 24.*i* can be piled into a substantially straight-lined pile. In this example the legs 58.3 of the bench 24.3 are connected to the piling elements 64.1 of bench 24.1 positioned under bench 24.3. In this example the legs 58.4 of the bench 24.4 are connected to the piling elements 64.2 of bench 24.2 positioned under bench 24.4.

According to another aspect of the invention a holder is provided, such as a pallet or a container, equipped with a plurality of benches. In FIG. 6*a* the holder is schematically represented as a plane 67. The plane 67 is, for example, an upper plane of a pallet or a bottom of a container. The plane 67 can be provided with attachment means (not demonstrated) for attaching the bench 24 thereto. The attachment means can, for example, comprise a profile for attaching the legs 58 of the bench 24 thereto, for example, similar to the piling element 64.

In FIG. 6*a* the benches 24.*i* include an angle $\alpha$ between a normal to the plane 67 onto which the benches 24.*i* are piled. The angle $\alpha$ is predetermined such that a mass centre of a bench 24.3, 24.4 in the second pile layer 65.2 is positioned substantially straight above a mass centre of the bench 24.1, 24.2 in the first pile layer 65.1 connected to this bench, seen in a direction of the normal to the plane 67. In this example the angle $\alpha$ is less than ninety degrees. Thus the benches in this example lean over forward. Optionally, the compact pile, for example in or on the holder, can also comprise additional pile layers. In connection herewith a mass centre of a bench in a higher positioned pile layer is, preferably, positioned straight above a mass centre of the bench connected to that bench positioned in a lower pile layer, seen in a direction of the normal to the plane 67. This offers the advantage that the mass centres of the piled, connected benches are substantially positioned above each other so that a stable pile is obtained. In the event the benches 24.1 are stored in a container it is moreover possible that the angle $\alpha$ is predetermined such that the compact pile of the benches 24.*i* leans over against at least one wall of the container.

In a preferred embodiment a plurality of benches is included in a compact pile which compact pile can, substantially, be included in a predetermined spatial dimension. The spatial dimension is preferably less than 3 meters wide, more preferably less than 1.5 meters wide. The spatial dimension is preferably less than 2.5 meters high. The holder in or on which the plurality of benches is placed preferably has such dimensions that the holder can be included in the spatial dimension. Preferably the holder is, substantially, 1.5 meters wide, 1.25 meters deep and 2.4 meters high. These dimensions are especially suitable for transportation of the holders with regular means such as, for example, a truck. In case of the latter dimensions of the holder the compact pile comprises, for example, four piled layers of benches each provided with three seats, where each piled layer comprises eleven benches positioned behind each other.

Optionally, the construction demonstrated in FIGS. 5*a*, 5*b*, 6*a* and 6*b* can also be applied to removable stands where the seat and/or bench is positioned on the support structure instead of on the floor element. Optionally, the construction demonstrated in FIGS. 5*a*, 5*b*, 6*a* and 6*b* can further be applied to permanent stands. In the latter case the seat and/or bench can be positioned as desired for obtaining the at least one seat or be left out (removed) for obtaining the at least one standing.

The support structure 2 of the removable stand 1 according to the invention comprises posts 6.*i*, 8.*i* and, in the constructed condition, trusses 10, 12.*j*. 14 positioned between the posts 6.*i*, 8.*i*. FIG. 7 demonstrates a schematic representation of a detail of the support structure 2. FIG. 7 demonstrates a part of the post 8.1 and a part of the truss 14. In this example the truss 14 is connected to the post 8.1. In connection therewith truss 14 is provided with a ridge 70 and a housing 72 and the post 8.1 is provided with a notch 74 corresponding with the ridge 70 and a pin 76 corresponding with housing 72 where, in use, the housing 72 falls over the pin 76 and the ridge 70 falls into notch 74. Optionally, the truss 14 is provided with two or more housings 72 positioned above each other and the post 8.1 is provided with two or more pins 76 corresponding with the respective housings 72. Optionally, the post 8.1 is provided with the ridge 70 and/or the housing (or housings) 72 and the truss 14 is provided with the notch 74 and/or the pin (or pins) 76.

In this example the post 8.1 is on four sides, substantially staggered by ninety degrees, with respect to each other provided with the notch 74 and the pin 76. As a consequence the post 8.1 can be connected to four trusses 10, 12.*j*, 14 substantially staggered ninety degrees with respect to each other.

In the examples of FIGS. 1, 2*a*, 2*b*, 3*a* and 3*b* the trusses 12.*j* extend at the left and right side 32, 34 of the floor element 4 slanting upwards in a direction from the front side 28 of the floor element 4 to the rear side 30 of the floor element 4. In these examples the trusses 12.*j* are provided with a bottom post 13 which, in use, extends in a substantially horizontal direction. In the examples the bottom post 13 is positioned at a level positioned higher than the bottom attachment point 15 of the truss 12.*j*. As a result hereof the distance from the bottom post 13 up to the underground is larger than in case the bottom post extends in a direction substantially parallel to the direction into which the truss 12.*j* extends, towards the bottom attachment point 15 of the truss 12.*j*. This offers the advantage that more 'head room' is provided under the truss 12.*j* to walk under the truss, for example by spectators, or to store goods under the truss 12.*j*.

In a preferred embodiment, in the constructed condition, each truss 10, 12.*j*, 14 is, free from clamping, attached to two posts 6.*i* and/or 8.*i*. In this example the ridge 70 and the corresponding notch 74 and the housing 72 and the corresponding pin 76 are executed in such manner that, in the constructed condition, the ridge 70 is, free from clamping, attached to the notch 74 and the housing 72 is, free from clamping, attached to the pin 76. This offers the advantage that the support structure can easily, for example by means of a fork-lift truck, be constructed and/or removed since no clamping force needs to be overcome upon positioning and/or removing of the trusses between the posts.

If desired the truss 10, 12.*j*, 14 can be locked to the post 6.*i*, 8.*i*, for example by means of a pin 71 which is placed through a hole 73 in the truss and a hole 75 in the post. This offers the advantage that, even though in the constructed condition the ridge 70 is, free from clamping, attached to the notch 74 and the housing 72 is, free from clamping, attached to the pin 76, possible margins with respect to the connection of the truss 10, 12.*j*, 14 to the post 6.*i*, 8.*i* can be removed by means of the wedge 77 so that the support structure 2 forms a solid and/or stabile whole. In addition, or as an alternative, the at least one pin 76 can be locked to the corresponding housing 72, for example by means of a wedge.

The support structure 2 of the stand 1 can be removed in a fast manner by means of driving a fork-lift truck between two (rows of) posts and (successively) lift, by means of the loaders of the fork-lift truck, the trusses out of the notches 74 and of the pins 76. It is consequently possible to remove a plurality of trusses from the support structure by means of the loaders before storing the trusses, for example on a pallet or in a container.

FIG. 8 demonstrates a schematic view from above of a removable stand 1 according to the invention. In FIG. 8 the removable stand 1 comprises a plurality of floor elements 4*a*-4*e*. In this example the floor elements 4*a* have, in the view from above, a substantially rectangular circumference, for example as elaborated in relation to FIG. 1-4*b*. In FIG. 8 the stand is further provided with a floor element 4*b* with a, in the view from above, substantially triangular circumference and a floor element 4*c* with a, in the view from above, substantially circle sector shaped circumference. In FIG. 8 the stand 1 is further provided with a floor element 4*d* with a, in the view from above, substantially trapezium-shaped circumference and a floor element 4*e* with a, in the view from above, substantially circle are shaped circumference. Optionally, the floor elements 4*a*-4*e* can be used for creating a bend in the stand 1.

Optionally, differently shaped floor elements for creating a bend in the stand such as, for example, but not limited to, a pentagon-shaped floor element, a (truncated) diamond-shaped floor element or a (truncated) kite-shaped floor element whether or not in combination with, for example, rectangular adapter pieces can be included.

In the example of FIG. 8 the support structure 2 is, under the floor elements 4*a*-4*e*, at at least each corner of each floor element 4*a*-4*e* provided with a post 6.*i*, 8.*i*, in FIG. 8 indicated by S. In the example of FIG. 8 the support structure 2 is, under the floor elements 4*a*-4*e*, adjacent each side of each floor element 4*a*-4*e* provided with a truss 10, 12.*j*, 14. With respect to the example of FIG. 8 furthermore applies that a post S in use positioned at the front side 28 of one of the floor elements 4*a*-4*e* is lower than a post S in use positioned at the rear side 30 of such floor element 4*a*-4*e*. Further, with respect to this example applies that a truss extending at the front side 28 of one of the floor elements 4*a*-4*e* is lower than a truss extending at the rear side 30 of such floor element 4*a*-4*e*. Preferably, the trusses at the sides of a floor element extend slanting upwards into a direction from the front side 28 of such floor element to the rear side 30 of such floor element.

Note that in the example of FIG. 8 a truss 14 at a rear side 30 of a floor element also serves as a truss 10 at a front side 28 of a floor element positioned behind such floor element. Note that in the example of FIG. 8 a post 8,*i*. in FIG. 8 indicated by S, at a rear side 30 of a floor element also serves as a post 6.*i*, in FIG. 8 indicated by S, at a front side 28 of a floor element positioned behind such floor element. Optionally, in this example the length of the posts S in a direction from the front side 28 to the rear side 30 of the stand 1 can gradually increase. The posts can be provided with known means for adjusting the length of the post taking irregularities of the underground into consideration.

In the example of FIG. 8 the support structure 2 is, under the floor elements 4*a*-4*e*, at at least each corner of each floor element 4*a*-4*e* provided with a post S and adjacent each side of each floor element 4*a*-4*e* provided with a truss 10, 12.*j*, 14. Optionally, it is also possible to, for example, include longer trusses so that a plurality of floor elements, for example two floor elements, is included in an assembly of four posts S and four trusses 10, 12.*j*, 14 as, for example, described in relation to FIGS. 3*a* and 3*b*.

In the example of FIG. 8 the floor elements 4*a*-4*e* are, on their front side 28, narrower than their rear side 30. As a result hereof it is possible to construct stand 1 in such manner that all spectators substantially see the same spectacle. Optionally, it is also possible that the floor elements 4*a*-4*e* are wider at their front side 28 than at their rear side 30. This provides, for example, the possibility to have the stand 1 follow the contour of a track, for example for (car) races.

FIG. 9 demonstrates a schematic representation of a third embodiment of a removable stand 1 according to the invention. FIG. 9 demonstrates a stand 1 provided with a support structure 2 and a plurality of floor elements 4.*n* (n=1, 2, 3, . . . ). In the example of FIG. 9 the floor elements 4.3 and 4.4 are, respectively, placed above the floor elements 4.1 and 4.2. As a result hereof in FIG. 9 a first layer 78 with seats is created and a second layer 80 with seats positioned above the first layer 78. As a consequence the capacity of the stand, that is the number of seats per square metre, increases. Optionally, the first layer and/or the second layer can additionally or alternatively also include standings.

In the example of FIG. 9 the first layer 78 and the second layer 80 comprise floor levels positioned behind each other and positioned at a distance in height. Optionally, the first layer 78 or the second layer 80 can also be constructed as a platform or stage equipped with a single floor level. As a result hereof it is, for example, possible to include a loge and a stand where one is, at least partially, situated over the other.

In the example of FIG. 9 posts are located on the first layer 78 between the seats 22 and/or benches 24. It is possible that the presence of the posts on the first layer 78 prevents that close to, for example immediately next to, the post a seat 22 and/or bench 24 is placed. As a consequence the number of seats on the first layer is reduced. It is possible to in a row 18 with seats between two posts have the seats stagger sideways in relation to the seats in a row 18 without posts. The seats in a row 18 with seats between two posts can, for example, stagger sideways over a distance corresponding with half the width of a seat in relation to the seats in a row without posts. As a consequence the number of seats which is lost as a result of the presence of the posts on the first layer 78 can be reduced.

In FIG. 9 the floor elements 4.*n* are desired in a stepped manner, that means that the floor elements 4.*n* consist of floor levels positioned behind each other and positioned at a distance in height. Optionally, it is moreover possible to provide a removable stand wherein, in use, above or under a first layer of standings and/or seats an additional layer of standings and/or seats is included wherein the stand is provided with non-stepped floor elements. In that case the removable stand comprises of a support structure and a plurality of floor elements wherein the support structure comprises posts and, in use, trusses positioned between the posts wherein, in use, the floor elements are positioned on the support structure and wherein, in use, the at least one floor element of the plurality of floor elements is positioned over another floor element of the plurality of floor elements.

In the examples the floor elements are designed such that, in the event the stand 1 is provided with a plurality of floor elements, in use, each floor element of the plurality of floor elements is free from overlap with any other floor element of the plurality of floor elements. As a result hereof it is possible to position each floor element of the plurality of floor elements on the support structure irrespective of the other floor elements. It is, for example, possible to position each floor element in a substantially vertical downwards direction on the support structure, for example by means of a hoisting device such as a fork-lift truck or a hoisting crane. As the floor element to be positioned does not overlap neighbouring floor elements it is not necessary to position the floor elements in a predetermined sequence.

In the examples the floor elements of the plurality of floor elements are free from coupling with the other floor elements of the plurality of floor elements, a floor element is, for example, free from securing against floor elements adjacent to such floor element. As a consequence it is not necessary to mutually connect the floor elements. As a result hereof it is possible to construct and/or remove the removable stand faster.

It is possible that the floor elements are free from securing to the support structure. Preferably, for example, a weight and/or geometry and/or dimension of the floor element is predetermined such that the floor element cannot be removed from the support structure by the spectator or by a number of spectators.

Optionally, the floor element, for example the stepped floor element, is provided with openings, for example to let air through, for example to prevent getting the floor element blown up and/or to supply (heated) air. In case of the stepped floor element these openings can, for example, be positioned in the, in use, upstanding part between two floor levels. In a preferred embodiment, in a constructed condition, each floor element of the plurality of floor elements substantially abuts against the neighbouring floor elements of such floor element of the plurality of floor elements. As a result hereof no opening, such as a groove, at least such narrow opening, is present between the neighbouring floor elements that there is no risk that a spectator, for example with a foot or a finger, gets, for example, caught between the floor elements. This also offers the additional advantage that no adapter pieces need to be placed between the neighbouring floor elements to fill up the opening. As a consequence the stand can be constructed and/or removed faster and/or with less manpower.

Optionally, in use, the stand is provided with at least one flight of stairs, for example to reach higher positioned floor levels. The flight of stairs can, for example, be connected to the support structure by means of a ridge and/or housing attached to the stairs which falls in the notch on the post corresponding with the ridge and a pin corresponding with the housing as discussed on the basis of FIG. 6. The flight of stairs can, in use, for example, comprise two plates with the steps in between, connected in a non-removable manner. The plates can be provided with a stair handrail. Preferably at least one plate of the flight of stairs constitutes an integral part with a stair handrail and possible connection means positioned between the same, such as bars. More in particular, both plates of the stairs each constitute an integral part with the stair handrail pertaining to the relevant plate. Between each plate and the stair handrail pertaining thereto connection means, such as bars, can be included.

In the examples the connection means for connecting the seat and/or bench to the floor element are each time located at the front side of a floor level so that the floor level substantially extends behind the connection means. It is also possible that the connection means for connecting the seat and/or bench to the floor element are each time located at the rear side of the floor level so that the floor level substantially extends in front of the connection means.

In FIGS. 1, 2*a*, 2*b*, 3*a*, 3*b* and 8 the entire surface of the floor elements is substantially filled with seats and/or benches to create seats. It is also possible that at least a path is left clear on a floor element, for example to, by means thereof, reach the seats. In connection therewith a number of adjacent positions and/or positions behind each other can be left without seats and/or benches.

These kinds of variants are all considered to fall within the scope of this invention.

The invention claimed is:

1. Method for constructing a removable stand, comprising constructing a support structure of posts and trusses that are positionable between the posts, and positioning a floor element on the support structure, wherein the floor element comprises a plurality of floor levels positioned behind each other and positioned at a distance in height, wherein the floor element is provided with at least two loading buckets for housing the loaders of a hoisting device for positioning the floor element on the support structure and/or removing the floor element from the support structure, wherein the at least two loading buckets extend in a plane that is parallel to the floor levels wherein the floor element is positioned on the support structure by the hoisting device.

2. Method according to claim 1, characterised in that the floor element is provided with connection means for connecting thereto at least one seat and/or bench.

3. Method according to claim 2, characterised in that the connection means are arranged for removably connecting at least one seat and/or bench to the floor element.

4. Method according to claim 2, characterised in that before the floor element is positioned on the support structure, at least one seat and/or bench is connected to the floor element by means of the connection means.

5. Method according to claim 4, characterised in that the at least one seat and/or bench is positioned on the floor element substantially at a ground level.

6. Method according to claim 1, characterised in that at least one truss is placed between two posts by a hoisting device.

7. Method according to claim 1, characterised in that at least one truss is removed between two posts by a hoisting device.

8. Removable stand comprising a support structure and a floor element, wherein the support structure comprises posts and trusses that are positionable between the posts, and wherein the floor element, in use, is positioned on the support structure, wherein the floor element comprises a plurality of floor levels positioned behind each other and positioned at a distance in height, wherein the floor element is provided with at least two loading buckets for housing the loaders of a hoisting device for positioning the floor element on the support structure and/or removing the floor element from the support structure, wherein the at least two loading buckets extend in a plane that is parallel to the floor levels.

9. Removable stand according to claim 8, characterised in that the floor element is provided with connection means for connecting at least one seat and/or bench thereto.

10. Removable stand according to claim 9, characterised in that the connection means are arranged for removably connecting at least one seat and/or bench to the floor element.

11. Removable stand according to claim 9, characterised in that the stand is further provided with at least one seat and/or bench connectable to the floor element by means of the connection means.

12. Removable stand according to claim 8, characterised in that the floor element, in view from above, has a substantially rectangular circumference.

13. Removable stand according to claim 8, characterised in that the floor element, in view from above, has a substantially trapezium-shaped or circle-arc shaped circumference.

14. Removable stand according to claim 8, characterised in that the floor element, in view from above, has a substantially triangular or circle-sector shaped circumference.

15. Removable stand according to claim 8, characterised in that the support structure, in use, at least one corner of the floor element is provided with a post and along one side of the floor element is provided with a truss.

16. Removable stand according to claim 15, characterised in that the support structure, in use, on each corner of the floor element is provided with a post and along each side of the floor element is provided with a truss.

17. Removable stand according to claim 8, characterised in that a post that, in use, is positioned at a front side of the floor element is lower than a post that, in use, is positioned at a rear side of the floor element.

18. Removable stand according to claim 8, characterised in that a first truss which, in use, extends along a front side of the floor element is positioned lower than a second truss which extends along a rear side of the floor element.

19. Removable stand according to claim 8, characterised in that, in use, the trusses at the sides of the floor element slant upwards in a direction from the front side of the floor element to the rear side of the floor element.

20. Removable stand according to claim 8, characterised in that, in use, the floor element is connected to at least one truss of the support structure.

21. Removable stand according to claim 20, characterised in that in use the floor element rests on at least one truss of the support structure.

22. Removable stand according to claim 8, characterised in that, in use, the floor element is connected to at least one post.

23. Removable stand according to one of claim 21, characterised in that, a truss that, in use, is positioned at the side of the floor element is provided with a support area for, in use, resting the floor element thereon.

24. Removable stand according to claim 23, characterised in that, in use, the floor element at least rests on two trusses each positioned at another side of the floor element, wherein the support area on these trusses extend in a substantially horizontal direction.

25. Removable stand according to claim 8, characterised in that the floor element is rigid to such extent that it can support its own weight and the weight of the positioned seats and/or benches whilst the floor element is being positioned on the support structure.

26. Removable stand according to claim 8, characterised in that the floor element comprises a frame and a floor plate.

27. Removable stand according to claim 8, characterised in that the floor element comprises three floor levels positioned behind each other and positioned at a distance in height.

28. Removable stand according to claim 8, characterised in that the floor element comprises a stepped frame and a plurality of floor plates positioned at a distance in height.

29. Removable stand according to claim 28, characterised in that the floor element comprises three floor plates.

30. Removable stand according to claim 26, characterised in that the frame is manufactured of bent metal plate.

31. Removable stand according to claim 26, characterised in that the frame comprises U-profiles extending in a width direction and/or a depth direction of the floor element.

32. Removable stand according to claim 26, characterised in that the at least one floor plate is manufactured of a plate material.

33. Removable stand according to claim 31, characterised in that the loading buckets extend in the U-profiles.

34. Removable stand according to claim 9, characterised in that the connection means comprise a profile attached to or in the floor element for, therein or thereon, positioning at least one seat and/or bench.

35. Removable stand according to claim 11, characterised in that the at least one seat and/or bench is provided with a foldable seat area.

36. Removable stand according to claim 35, characterised in that the at least one seat and/or bench is provided with a resilient element for folding the seat area.

37. Removable stand according to claim 11, characterised in that a back of the at least one seat and/or bench is spaced backwards in relation to the connection means.

38. Removable stand according to claim 11, characterised in that the at least one seat and/or bench is provided with at least one leg.

39. Removable stand according to claim 38, characterised in that the at least one leg substantially extends in a plane that extends substantially perpendicular to the back and a seat area of a seat and/or bench and, substantially, does not intersect the back and the seat area of that seat and/or bench.

40. Removable stand according to claim 38, characterised in that the at least one seat and/or bench is provided with two legs.

41. Removable stand according to claim 8, characterised in that, in use, each truss attaches to two posts free of clamping.

42. Removable stand according to claim 41, characterised in that the truss is provided with at least one ridge, housing, notch and/or pin and that the post is provided with at least one notch corresponding with the at least one ridge, with at least one pin corresponding with the at least one housing, with at least one ridge corresponding with the at least one notch and/or with at least one housing corresponding with the at least one pin, wherein, in use, at least the at least one housing falls over the at least one pin and/or the at least one ridge falls in the at least one notch.

43. Removable stand according to claim 8, characterised in that the stand comprises a plurality of floor elements.

44. Removable stand according to claim 43, characterised in that, in use, each floor element of the plurality of floor elements is free from overlap with any other floor element of the plurality of floor elements.

45. Removable stand according to claim 43, characterised in that, in use, each floor element of the plurality of floor elements is free from coupling with any other floor element of the plurality of floor elements.

46. Removable stand according to claim 43, characterised in that, in use, each floor element of the plurality of floor elements substantially abuts sideways against the floor elements adjacent that floor element of the plurality of floor elements.

47. Removable stand according to claim 43, characterised in that at least one floor element of the plurality of floor elements is positioned over another floor element of the plurality floor elements.

48. Floor element for use in a removable stand, characterised in that the floor element comprises a plurality of floor levels positioned behind each other and positioned at a distance in height, wherein the floor element is provided with at least two loading buckets for housing the loaders of a hoisting device for positioning the floor element on a support structure and/or removing the floor element from the support structure, wherein the at least two loading buckets extend in a plane that is parallel to the floor levels.

49. Method according to claim 1 characterised in that the floor element is provided with at least two loading buckets for housing the loaders of either a fork-lift truck or a hoisting crane.

50. Removable stand according to claim 8 characterised in that the floor element is provided with at least two loading buckets for housing the loaders of either a fork-lift truck or a hoisting crane.

51. Removable stand according to claim 32 characterised in that the plate material is either metal, wood and/or plastic.

52. Removable stand according to claim 38, characterised in that the seat or bench comprises a back and seat area.

53. Removable stand according to claim 52 characterised in that the at least one leg substantially extends in a plane that extends substantially perpendicular to the back and seat area of a seat and/or bench and, substantially, does not intersect the back and seat area of that seat and/or bench.

* * * * *